United States Patent [19]

McLeod

[11] Patent Number: 4,521,957

[45] Date of Patent: Jun. 11, 1985

[54] METHOD OF CONSTRUCTING A MAGNETIC CORE

[75] Inventor: Ramon M. McLeod, Rome, Ga.

[73] Assignee: General Electric Company, King of Prussia, Pa.

[21] Appl. No.: 608,550

[22] Filed: May 11, 1984

Related U.S. Application Data

[63] Continuation of Ser. No. 355,785, Mar. 8, 1982, abandoned.

[51] Int. Cl.[3] ..... H01F 41/02

[52] U.S. Cl. ..... 29/609; 336/212; 336/217; 336/234

[58] Field of Search ..... 29/609, 602 R; 336/217, 336/216, 212, 234

[56] References Cited

U.S. PATENT DOCUMENTS 3,670,279 6/1972 Millsop et al. ..... 29/609 X 4,283,842 8/1981 DeLaurentis et al. ..... 29/609 X

*Primary Examiner*—Carl E. Hall

*Attorney, Agent, or Firm*—Robert A. Cahill; William Freedman

[57] ABSTRACT

Plural leg laminations of equal length are stacked in two groups having concealed stepped-lap joint halves at one ends and visible stepped-lap joint halves at the other ends. Plural yoke laminations of incrementally varying lengths are stacked in a first group having visible stepped-lap joint halves at each end and a second group having concealed stepped-lap joint halves at each end. A rectangular magnetic core is assembled by mating the visible joint halves of the first yoke group and the concealed joint halves of the two leg groups, and then mating the visible joint halves of the leg groups with the concealed joint halves of the second yoke group.

5 Claims, 2 Drawing Figures

METHOD OF CONSTRUCTING A MAGNETIC CORE

This application is a continuation of application Ser. No. 355,785, filed Mar. 8, 1982 now abandoned.

BACKGROUND OF THE INVENTION

The present invention relates to magnet cores for power transformers and particularly to a method for facilitating the construction of a rectangular, laminated magnetic core having stepped-lap joints between the leg and yoke portions of the core.

Stepped-lap joints in laminated magnetic cores are well known and have been formed to promote reduced core excitation current requirements, lower core losses, and decreased noise levels. Examples of stepped-lap joint cores are shown in U.S. Pat. Nos. 2,628,273, 3,153,215, 3,210,709, 3,477,053, 3,540,120 and 3,670,279. To simplify the manufacturing process, the leg and yoke laminations are typically cut to equal lengths; their ends being mitered. Upon assembly of the core, the leg and yoke portions of the core have their laminations in stacked relation with the midpoints incrementally, longitudinally offset. This creates a stepped relationship of the lamination ends at each end of any stacked group of leg and yoke laminations. Thus for any stacked group of laminations, the stepped ends face in opposite directions at the ends of the group. When the leg and yoke laminations are assembled individually to build up the core a layer at a time, assembly is straightforward, but very time consuming. To save time, it has been proposed to build up the core by assembling the leg and yoke laminations in groups of laminations. However, this poses a problem when one group of laminations is to be assembled with two other lamination groups, requiring the mating of two stepped-lap joints. Since the stepped ends of the one lamination group face in opposite directions, one stepped end must be tucked under a stepped end of one of the other groups—analogous to manipulating the last of the four flaps to close the end of a cardboard carton in sustained over and under relation.

This problem was addressed in the above-noted U.S. Pat. No. 3,670,279. To eliminate so-called "blind" stepped-lap joint assembly situations, the laminations are arranged in stacks of leg and yoke groups, with the laminations of each group being of incrementally different lengths. With the longitudinal midpoints of the laminations aligned and the laminations stacked according to length progressing from the shortest to the longest, the stepped ends of the laminations in any group face in the same direction. Thus, for example, a pair of leg lamination groups may be positioned in spaced parallel relation with their stepped ends faced upwardly, and then a pair of yoke lamination groups, oriented with their stepped ends faced downward, could then be simply set into place to complete the stepped-lap joints at the four corners. The principal drawback to this approach is that so many different lamination lengths are required, rendering the cutting and grouping operations more difficult and expensive.

SUMMARY OF THE INVENTION

In accordance with the present invention, there is provided a method for constructing a magnetic core which avoids the "blind" stepped-lap joint assembly situations discussed in U.S. Pat. No. 3,670,279 without unduly complicating other core manufacturing operations. Basically, the present invention provides for the assembly of a magnetic core from like groups of yoke laminations and like groups of leg laminations, wherein the laminations of one of the group types are of equal length and the laminations of the other group type are of incrementally different lengths. Thus, for example, the leg laminations of each group may have a common longitudinal dimension between their mitered ends, while the longitudinal dimension between the mitered ends of the yoke laminations in each group is incrementally varied. It will be appreciated that this relationship may be reversed, such that the lengths of the yoke laminations may be constant and the leg lamination lengths incrementally varied within their groups.

Assuming the former case, the equal length leg laminations are stacked in groups with their midpoints incrementally longitudinally offset such as to present at one group end a stepped-lap joint half facing in one direction, which is said to be visible to the assembler, and at the other group end a stepped-lap joint half faced in the opposite direction, i.e., concealed from the assembler. The yoke laminations are stacked in first groups and arranged according to length ranging from the shortest to the longest. With the yoke lamination longitudinal midpoints aligned, there is presented visible stepped-lap joint halves at both ends of each first yoke group. Second groups of stacked yoke laminations are also provided, with the yoke laminations in each arranged according to length ranging from the longest to the shortest. With the longitudinal midpoints of the yoke laminations in each second group aligned, there is presented concealed stepped-lap joint halves at each second group end. Thus the first and second yoke groups differ only in orientation in that one is inverted relative to the other.

To assemble a core, a first yoke group is set into place with its visible stepped-lap joint halves at each end facing the assembler. A pair of leg groups are then set into place perpendicular to the first yoke group with the concealed stepped-lap joint halves at their corresponding one ends mated with the visible stepped-lap joint halves of the first yoke group. This leaves the visible stepped-lap joint halves at the other ends of the leg groups facing the assembler for facile mating with the concealed stepped-lap joint halves at the ends of a second yoke group when the latter is set into place completing the core retangular loop. The core is built up to the desired number of lamination layers by assembling additional leg and yoke groups in the sequence first yoke group, leg groups, and second yoke group.

BRIEF DESCRIPTION OF THE DRAWINGS

For a fuller understanding of the nature and objects of the invention, reference may be had to the following detailed description taken in connection with the accompanying drawing, in which.

Corresponding reference numerals refer to like parts throughout the several views of the drawing.

DETAILED DESCRIPTION

Figure 1:
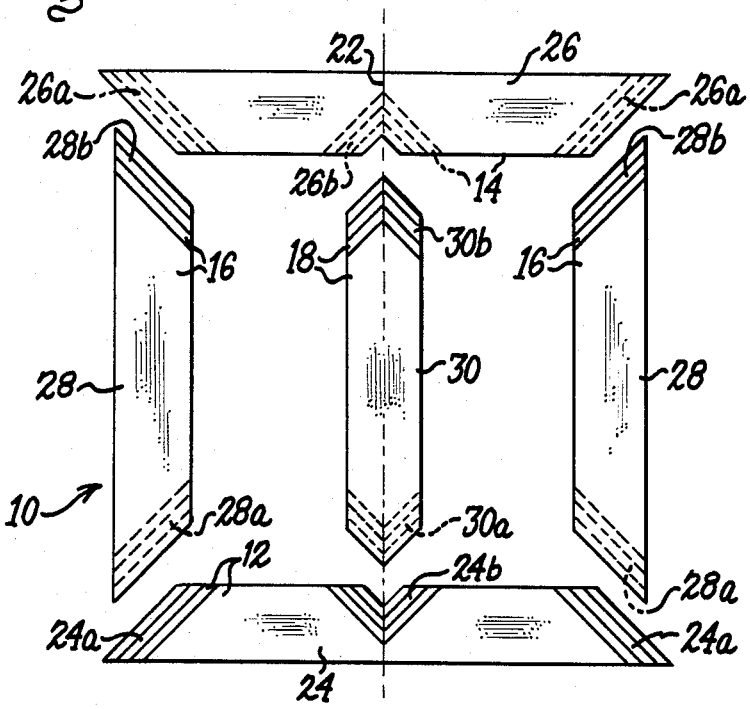
FIG. 1 is an exploded plan view of a magnetic core constructed in accordance with the present invention.
Figure 2:
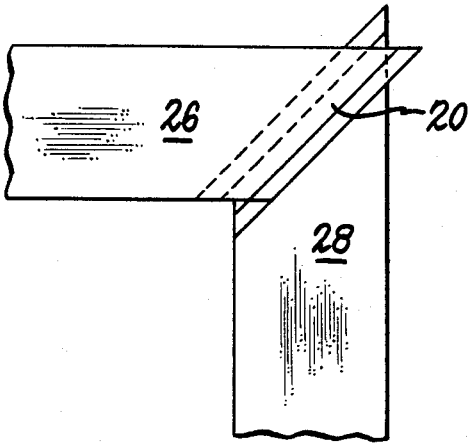
FIG. 2 is an enlarged fragmentary plan view of a magnetic core constructed in accordance with the present invention showing the stepped-lap joint achieved between leg and yoke core portions.

Referring now to the drawing, a magnetic core, generally indicated at 10 in FIG. 1, fabricated from a plurality of bottom yoke laminations 12, top yoke laminations 14, outer leg laminations 16, and center leg laminations 18 arranged in stacked relation and joined together in stepped-lap joint fashion as seen in FIG. 2 at 20 to complete a closed magnetic circuit. The ends of the upper and lower yoke laminations and the outer leg laminations are all diagonally cut or mitered as illustrated. The ends of the center leg laminations 18 are all cut in a double-mitered or V-shaped configuration, while the yoke laminations 12 and 14 are provided with complimentary V-shaped notches symetrical with the core centerline indicated at 22. All of the laminations are cut from a magnetic strip material of, for example, highly grain-oriented, cold-rolled silicon alloy steel having a most favorable magnetic direction aligned with the direction of strip elongation, i.e., the strip longitudinal axis.

In accordance with a signal feature of the present invention, the outer leg laminations 16 are of a common size and trapezoidal shape, as are the center leg laminations 18. The yoke laminations 12 and 14 are also of generally trapezoidal shape, but cut to incrementally different lengths.

As seen in FIG. 1, the bottom yoke laminations 12 are stacked together in a group, indicated at 24, according to length, with the shortest lamination on top facing the assembler, and the longest lamination on the bottom. While four bottom yoke laminations 12 are shown in bottom yoke group 24, it will be appreciated that the number may vary in practicing the invention. The laminations in group 24 are also arranged such that their longitudinal midpoints are all in registry and aligned with core centerline 22. As a consequance, there is created a visible (faced in the direction of the assembler) stepped-lap joint half 24*a* at each end of bottom yoke group 24. With four yoke laminations in the group, each joint half has four steps of equal tread width.

Top yoke laminations 14 are likewise arranged in a stack 26 according to length with their longitudinal midpoints in registry and aligned with core centerline 22. However, the longest top yoke lamination is situated on top of the stack and the shortest on the bottom. The lengths of the longest,intermediate and shortest laminations of top yoke group 26 are respectively equal to their counterpart laminations of bottom yoke group 24; the only difference being that the two yoke groups are inverted relative to one another. Consequently, the stepped-lap joint halves 26*a* created at the ends of top yoke group 26 are concealed, i.e., faced away from the assembler.

With regard to the V-shaped notches in the bottom and top yoke laminations, it is seen in FIG. 1, that the V-shaped notches in the yoke laminations are of incrementally varying depths, progressing from the shallowest depth in the longest yoke lamination to the deepest depth in the shortest yoke lamination. Thus, for bottom yoke group, these V-shaped notches present a visible stepped-lap joint half 24*b* and for the top yoke group they present a concealed stepped-lap joint half 26*b*.

As noted above, outer leg laminations 16 are of equal length. These laminations are stacked in outer leg groups 28 with their midpoints incrementally, longitudinally offset by a distance corresponding to the incremental length differential of the yoke laminations in groups 24 and 26. Consequently, the outer leg groups present a concealed stepped-lap joint halve 28*a* at one of their ends and visible stepped-lap joint halve 28*b* at their other ends. The center leg laminations 18 are arranged in the same manner as the outer leg laminations in a group 30, and thus provide a concealed stepped-lap joint half 30*a* at one group end and a visible stepped-lap joint half 30*b* at the other group end. The number of laminations in each leg and yoke group is equal, i.e., four in the illustrated embodiment.

To construct core 10 from the various lamination groups, first bottom yoke group 24 is set into place with its visible joint halves 24*a* at each end and intermediate joint half 24*b* all facing the assembler. Then the leg groups 28 and 30 are set into place with their concealed joint halves 28*a* and 30*a*, respectively, mated with the visible joint halves 24*a* and 24*b* of the bottom yoke group. Finally, the top yoke group is set into place with its concealed joint halves 26*a* and 26*b* mated with the visible joint halves 28*b* and 30*b* of the outer and center leg groups, respectively. This completes a four-layer build of magnetic core. The assembly sequence of bottom yoke group, leg groups, and top yoke group is repeated until the desired number of core layers is achieved. If desired, since the top and bottom yoke groups are identical except for their spatial orientation, bottom yoke group 24 could be set in position atop the previously assembled top yoke group 26. The center leg group 30 would then be switched end-for-end and assembled in position making joint halves 24*b* and 30*a*. The outer leg groups would be switched end-for-end and also from side-to-side before being assembled in position to make joint halves 24*a* and 28*a* in both instances. Top yoke group 26 is then set into place atop the last assembled bottom yoke group, incidentally mating joint halves 26*a*–28*b* and 26*b*–30*b*.

If desired, as suggested in the above-cited U.S. Pat. No. 3,210,709 a bonding compound may be applied to the edges of the laminations so as to maintain their grouped integrity during handling and core assembly.

From the foregoing description, it is seen that, assuming four laminations per group, the yoke laminations, 12 and 14 are cut to only four different lengths. The outer leg laminations 16 are all cut to the same length, as are the center leg laminations 18, regardless of the number of laminations per group. Thus, high joint visibility during core assembly is achieved without unduly complicating the lamination cutting and grouping procedures. It will be appreciated that high joint visibility could also be achieved by cutting the laminations of each leg group to incrementally different lengths and arranging them such that the stepped lap joint halves at each end face in the same direction. Then the laminations of each yoke group could be cut to the same length and arranged with the stepped-lap joint halves at each end faced in opposite directions. This is simply a reversal of the arrangement shown in the drawing. However, for the three-legged core configuration shown, this reversed arrangement complicates the V-shaped notching of the yoke laminations.

It will thus be seen that the objects of the invention are efficiently attained and, since certain changes may be made in the disclosed method without departing from the scope of the invention, it is intended that all matter contained in the foregoing description or shown in the accompanying drawings shall be interpreted as illustrative and not in a limiting sense.

Having described the invention, what is claimed as new and desired to secure by Letters Patent is:

1. A method of constructing a magnetic core comprising the steps of:

A. providing a plurality of first laminations each having mitered ends and parallel sides to present a trapezoidal configuration, said first laminations having equal lengths;

B. providing a plurality of second laminations each having mitered ends and parallel sides to present a trapezoidal configuration, said second laminations having incrementally varying lengths;

C. arranging a plurality of said second laminations in a first stacked group with their mid-length points in registry such as to present visible stepped-lap joint halves at each end of said first group;

D. arranging a plurality of said second laminations in a second stacked group with their mid-length points in registry such as to present concealed stepped-lap joint halves at each end of said second group, the number of said second laminations in each said second stacked group being equal to the number of said second laminations in each said first stacked group;

E. arranging said first laminations in plural stacked third groups with the mid-length points thereof incrementally, longitudinally offset to present visible stepped-lap joint halves and concealed stepped-lap joint halves at opposite ends of each of said third groups, the number of said first laminations in each said stacked third group being equal to the number of said second laminations in each said second stacked group;

F. assembling a pair of said third groups to said first group such that said concealed stepped-lap joint halves at corresponding one ends of said third group pair are respectively joined with the visible stepped-lap joint halves at the two ends of said first group;

G. assembling said second group to said third group pair such that said concealed stepped-lap joint halves at the two ends thereof are joined with the visible stepped-lap joint halves at the corresponding other ends of said joint group pair; and H. repeating steps F. and G. a requisite number of times to complete the build of said core.

2. The method defined in claim 1, wherein said first laminations are core leg laminations, said second laminations of said first group are core bottom yoke laminations, and said second laminations of said second group are core top yoke laminations.

3. The method defined in claim 2, wherein said first laminations are core outer leg laminations, said method further including the steps of providing each said bottom and top yoke laminations with a V-shaped notch in a lateral edge thereof at a location aligned with the lamination mid-length point, the depths of said notches being incrementally varied from yoke lamination to yoke lamination according to the yoke lamination length, whereby upon arranging said yoke laminations in said first group, said notches present a visible stepped-lap joint half, and upon arranging said yoke laminations in said second group, said notches present a concealed stepped-lap joint half, providing a plurality of center leg laminations having V-shaped ends and equal lengths, arranging a plurality of said center leg laminations in a fourth group with the mid-length points thereof incrementally longitudinally offset to present a visible stepped-lap joint half at one group end and a concealed stepped-lap joint half at the other group end, and assembling said fourth group to said first group along with said pair of third groups of outer leg laminations such as to join the concealed joint halves at the corresponding one ends thereof with the exposed joint halves at the ends and mid-length point of said first group, the assembly of said second group to said third and fourth groups being such as to join the concealed joint halves at the ends and mid-length point of said second group with the exposed joint halves presented at the corresponding other ends of said third group pair and said fourth group.

4. The method defined in claim 3 which further includes the steps of assembling an additional pair of said third groups and an additional fourth group to an additional first group and assembling an additional second group to said additional third group pair and said additional fourth group, whereby to complete the build of said core.

5. The method defined in claim 4, wherein the number of laminations in each said first, second, third and fourth groups is equal.

* * * * *